United States Patent [19]

Walter

[11] 4,392,131

[45] Jul. 5, 1983

[54] INTEGRATABLE ACTIVATION MODULE FOR PASSIVE ELECTROOPTICAL DISPLAYS

[75] Inventor: Karl-Heinz Walter, Grafing, Fed. Rep. of Germany

[73] Assignee: Siemens Aktiengesellschaft, Berlin & Munich, Fed. Rep. of Germany

[21] Appl. No.: 186,142

[22] Filed: Sep. 10, 1980

[30] Foreign Application Priority Data

Sep. 27, 1979 [DE] Fed. Rep. of Germany ..... 2939235

[51] Int. Cl.[3] ..... G09G 3/00

[52] U.S. Cl. ..... 340/803; 340/719; 340/789; 340/811

[58] Field of Search ..... 340/718, 719, 789, 803, 340/804, 805, 811, 783, 784

[56] References Cited

U.S. PATENT DOCUMENTS

| | | | |
|---|---|---|---|
| 3,634,849 | 1/1972 | Nishizawa et al. | 340/719 |
| 3,668,688 | 6/1972 | Schmersal | 340/718 |
| 3,792,465 | 2/1974 | Collins et al. | 340/718 |
| 3,862,360 | 1/1975 | Dill et al. | 340/719 |

*Primary Examiner*—Marshall M. Curtis

*Attorney, Agent, or Firm*—Hill, Van Santen, Steadman, Chiara & Simpson

[57] ABSTRACT

An activation module for multiplex passive displays integrates the output drivers of the module into two groups which, independently of one another, can be connected either to the columns or to the rows of an electrode matrix. The four pulse voltages necessary for this purpose are internally formed. Preferably, the switching unit has driver groups with 10 or 35, respectively, output drivers and can thus activate a 10-position data row with 5×7 matrices. The component can be constructed with known elements of CMOS technology. The proposed multiplex driver finds use, above all, in medium-to-high information liquid crystal displays.

6 Claims, 6 Drawing Figures

INTEGRATABLE ACTIVATION MODULE FOR PASSIVE ELECTROOPTICAL DISPLAYS

BACKGROUND OF THE INVENTION

1. Field of the Invention

The present invention relates to an activation or drive module for a passive electrooptical display which has electrodes which form rows or columns of a matrix and which can be selected on a time-division multiplex basis.

2. Description of the Prior Art

Such a multiplex driver is known in the art, for example from Hermann Behrent, "Multiplexen von Flüssigkristall-Anzeigeeinheiten", Elekronik, 1978, pamphlet 4, pp. 117–120.

Previously, a drive module for multiplex displays were, as a general rule, so designed that they could be connected either only with the columns or only the rows of the electrode matrix, and, in addition, required a series of additional units, such as, for example, pulse generators. In order to remain as universal as possible, the module was provided with only a few output drivers, and it was interconnected, as required, with further units to form a cascade; for example, the driver of the reference set forth above controls eight outputs. It is obvious that in the case of such an integration design, the drive circuit requires relatively great space and is comparatively expensive. These disadvantages are of importance above all, when the display device must process larger quantities of information.

SUMMARY OF THE INVENTION

Therefore, the object of the present invention is to provide a circuit unit capable of integration which can activate or drive the rows as well as the columns of a conductor matrix, which is at the same time relatively simply constructed and requires a minimum of peripheral components.

This object is achieved in a circuit of the type generally mentioned above by employing a shift register which receives serial data, a switching register which receives the data in parallel from the shift register, and in each of the outputs of a switching register, a two-channel analog switch is provided which, depending upon switching position, receives one signal or another of a pair of analog signals. More specifically, n and m output drivers are integrated into a group, a pulse generator providing the analog signal pairs is a constituent part of the module and contains six inputs, four outputs, four two-channel analog selection switches which are externally switchable, as well as two digital switches connected in synchronism in complementary switching positions, whereby four inputs receive different voltage levels, respectively, and the two remaining inputs are in each instance connected with one of the two terminals of a dc voltage source, two outputs (row or line) emit the analog signal pair for the rows (or lines) and two additional outputs (column outputs) emit the analog signal pair for the columns, the select switches in each instance connect one of the outputs with one of two inputs in such a manner that both output driver groups receive, independently of one another, either row signal pairs or column signal pairs, the one digital (on-off) switch is connected between one terminal and one of the two row outputs, and the other on-off switch is connected between the other terminal and one of the two column outputs.

The proposed switching unit offers a series of advantages: the two prescribed groups consisting of n or m, respectively, drivers, provide the possibility of supplying voltage up to n+m rows, up to n+m columns, up to n columns and m rows, or up to m columns and n rows. The values n and m shall be selected, in practice, to be so great that the activation module can be employed for the most frequent instances of application.

All required pulse voltages are internally generated The pulse generator is here composed of simple elements, for essentially it consists only of four externally adjustable two-channel analog switches and a transfer switch formed by two digital (on-off) switches. The individual switches can link together the inputs and outputs of the generator in such a manner that the pulse generator forms, from the four different potentials, the two analog signal pairs C, D and $\overline{C}$, E, with which the necessary "off" and "on" effective voltages can be generated. The generator can process the most divergent voltage levels, so that it is possible to always match the potentials to one another in such a manner which is most favorable for the selected multiplex relation.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
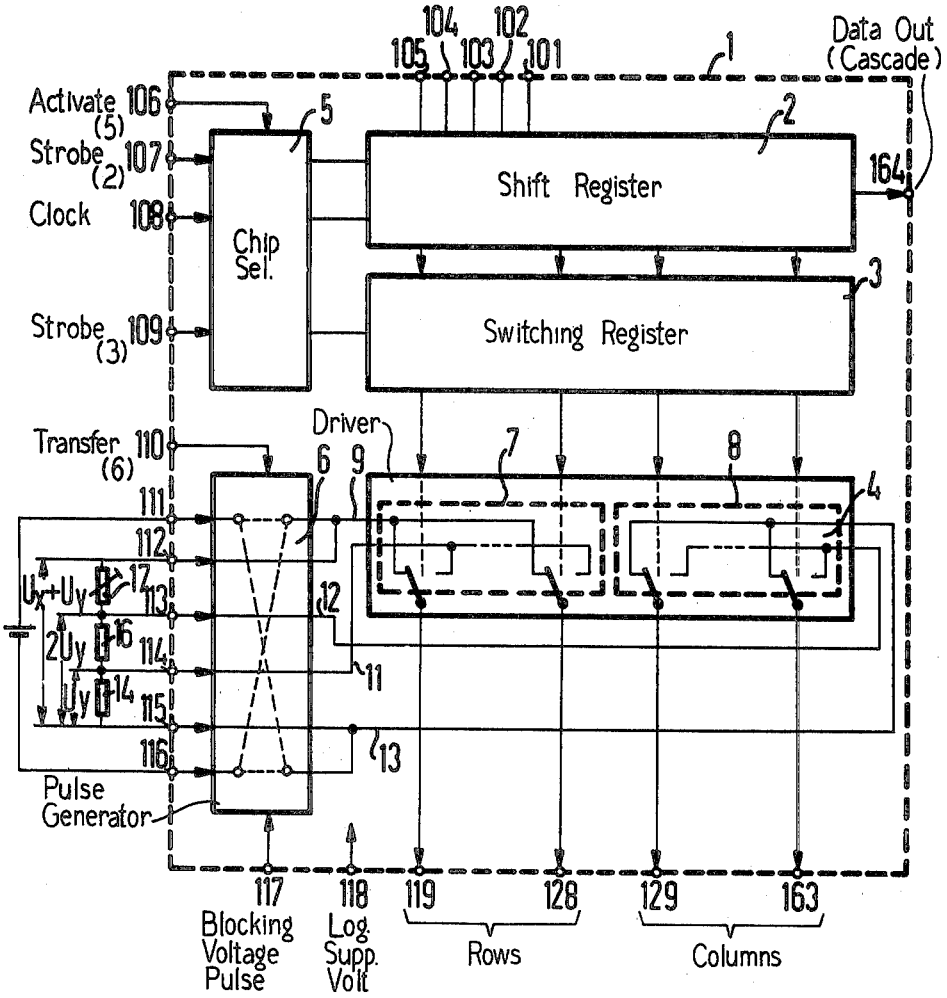
FIG. 1 is a block diagram illustration of an embodiment of the invention.
Figure 2:
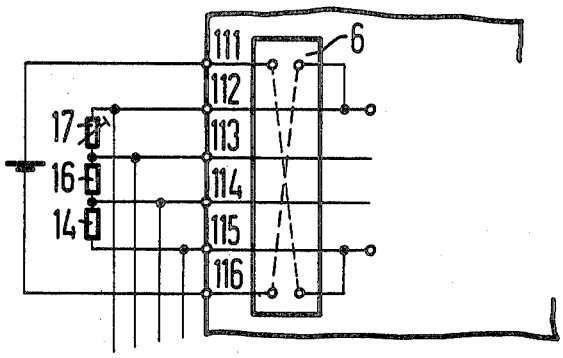
FIG. 2 is a schematic illustration of a pulse generator having a first switch configuration.

The multiplex driver of FIG. 1, whose circuit boundaries are delineated by a broken line 1, serves the purpose of activating (selecting, driving) a data row having ten point characters, hereinafter simply "marks". The module contains, in detail, a shift register 2, a switching register 3, an output driver unit 4, a chip selector 5, and a pulse generator 6. These elements are interconnected in the following manner. The outputs of the shift register 2 extend to the switching register 3 which, in turn, controls the output driver unit 4. In the present case, a total of 45 output drivers are provided, of which the drivers 1–10 form a first group, and the drivers 11–45 form a second group. These groups, which, on the drawing, are enclosed by broken lines 7, 8, respectively, each control two supply lines 9, 11 or 12, 13, respectively, originating from the pulse generator 6.

The entire unit has 64 terminals. Of these, the terminals 101–105 receive the data for the shift register 2, the terminal 106 receives the activation signal for the chip selector 5, the terminal 107 receives a transfer clock pulse (strobe) for the shift register 2, the terminal 108 receives the shift clock pulse (clock) for the data input (for example a maximum of 1 MHz), the terminal 109 receives a strobe for the shift register 3, the terminal 110 receives the transfer signal for the pulse generator 6 (for example a maximum of 1 kHz), the terminal 111 receives the voltage from one of the two terminals of a dc voltage source, the terminal 112 receives the voltage level for a "selected" row, the terminal 113 receives the voltage level for a column having the information "1", the terminal 114 receives the voltage level for a "non-selected" row, the terminal 115 receives the potential for a column having the information "0", the terminal 116 receives the voltage from the other terminal of the dc voltage source, the terminal 117 receives a blocking voltage pulse, and the terminal 118 receives the supply voltage for the logic stages. The terminals 119–128 are connected to the rows and the terminals 129–163 are connected to the columns. The terminal 164 serves as a data output and makes cascading possible.

The different voltage levels for the inputs 111–115 are tapped from a group of external resistors. This group, which is present only once for the entire circuit, determines the pulse levels of all output drivers, so that the voltage levels at all locations of the system within the boundaries is the same. In the most simple case, the voltage level generator comprises three series-connected ohmic resistors (fixed resistors 14, 16 and a variable resistor 17), of which the fixed resistors have the same value $R_1$. The resistance value of the resistor 17 should be set to $(\sqrt{N}-1)\,R_1$ (N=number of multiplex steps); for, in this case, the ratio S between the effective voltages "on" and "off" becomes the greatest, and hence the optical contrast is optimized.

Figure 3:
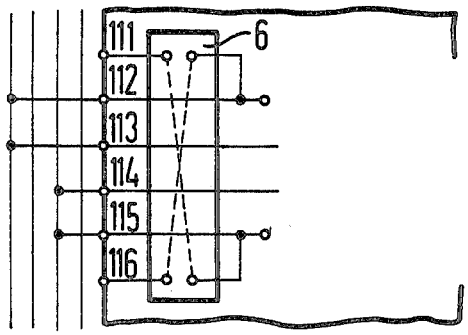
FIG. 3 is a schematic illustration of a pulse generator having a second switch configuration.
Figure 4:
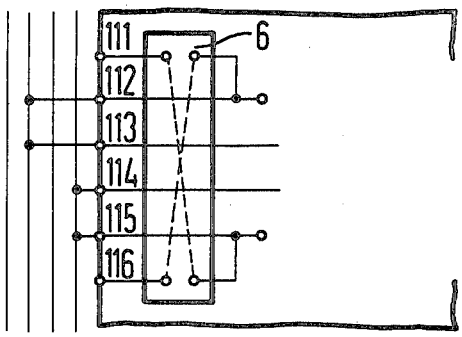
FIG. 4 is a schematic illustration of a pulse generator having a third switch configuration.
Figure 5:
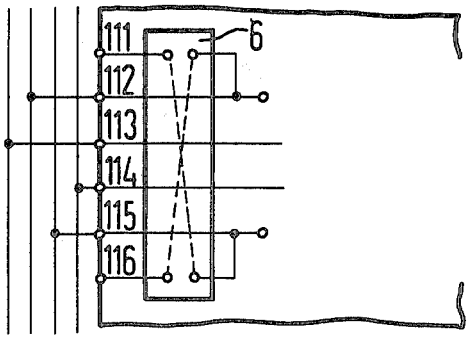
FIG. 5 is a schematic illustration of a pulse generator having a fourth switch configuration.

Referring to FIGS. 2–5, the positions the analog switches of the pulse generator 6 are illustrated. In the case of the pulse generator of FIG. 2, the first driver group controls the rows and the second driver group controls the columns of the matrix. The pulse generators of FIGS. 3 and 4 are so connected that their two groups supply exclusively column or row pulses. The pulse generator of FIG. 5 supplies the first driver group with column signals and the second driver group with row signals.

Figure 6:
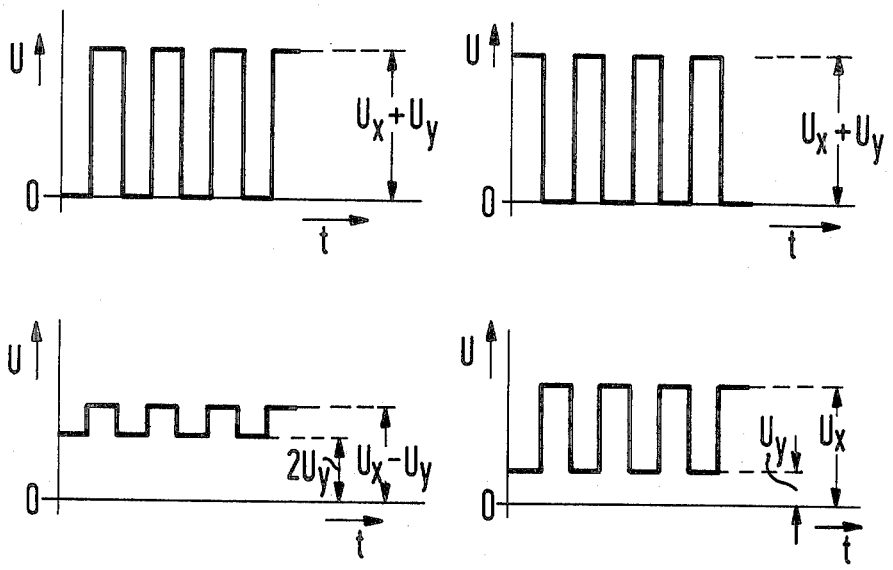
FIG. 6 is a series of pulse diagrams relating to the circuit arrangement.

FIG. 6 illustrates the shapes of the signals supplied by the pulse generator. In the left column, the analog signal pair of the columns is illustrated; namely, above, for the information value "1", and below for the value "0". The right column, in which the analog signal pair for the rows is illustrated, contains, above and below, the pulse trains for the "selected" or "non-selected" row, respectively.

In order to be able to obtain the required effective voltages also from battery voltages which are too high per se, the pulse generator 6 is periodically blocked by a blocking pulse ("disable" signal) fed in at the terminal 117. The period of influence is here to be determined on the basis of the relationship $$U_{eff2} = U_{eff1} \cdot \sqrt{T/(T+t)}$$

where t is the duration of the disable signal and (T+t) is the matrix addressing time.

The described activation module is composed of CMOS components and, with it 64 terminals, made be readily realized in the recently-developed "micropack" technology. Such an IC is particularly compact and, because of its flexible support, permits the most varying contact geometries.

The present invention is not restricted to the exemplary embodiment discussed herein. Therefore, it can be thoroughly recommended to provide both driver groups with other n and/or other m values. However, the groups should in each instance comprise so many drivers that the most common matrix formats can be handled and as few drivers as possible remain redundant. For the remainder, it is up to applications personnel to decide in what manner the potentiometer 17 will be adjusted, the disconnection time t and the switching position of the selected switches. Advantageously, all quantities, for example, also the optimum voltage levels for a prescribed number of multiplex steps, will be programmed in by a microprocessor.

Other changes and modifications may become apparent to those skilled in the art without departing from the spirit and scope of the invention. I therefore intend to include within the patent warranted hereon all such changes and modifications as may reasonably and properly be included within the scope of my contribution to the art.

I claim:

1. An activation circuit for a passive electro-optical display which has electrodes in a matrix of columns and rows which are to be driven on a time division multiplex basis, comprising:

a shift register for receiving serial data representing information to be displayed;

a switching register connected to said shift register for receiving the data in parallel;

first and second driver groups, including m and n drivers for connection to the electrodes of the matrix, each driver respectively connected to said switching register and including a two-channel analog switch having two switch positions respectively selected by said switching register and, depending on its switch position, receiving one signal or another of a pair of analog signals; and a pulse generator including six inputs, four outputs, four select switches which are externally switchable two-channel analog select switches, and two digital switches connected for operation in synchronism in complementary switching positions, four of said six inputs receiving said different voltages, respectively, the two remaining of said six inputs connected, respectively, with the two terminals d.c. voltage source, two of said four outputs provided to emit the analog signal pairs to the row electrodes and the two other of said four outputs provided to emit analog signal pairs for the column electrodes, said select switches operable to connect a respective output with two of said inputs in such a manner that both driver groups receive, independently of one another, either row signal pairs or column signal pairs.

2. The circuit of claim 1, wherein:

said pulse generator includes a clock pulse input for receiving clock pulses for timing the operation of said select switches.

3. The circuit of claim 1, wherein:

said pulse generator includes a blocking input for receiving a blocking pulse to disable the same for a predetermined interval.

4. The circuit of claim 1, wherein:

m is equal to 35; and n is equal to 10.

5. The circuit of claim 1, wherein:

said circuit is a CMOS structure.

6. The circuit of claim 1, and further comprising:

a plurality of resistors connected to some of said inputs for programming the different voltage levels.

* * * * *